United States Patent [19]

Serracant et al.

[11] Patent Number: 4,558,575

[45] Date of Patent: Dec. 17, 1985

[54] MACHINE FOR LIQUID TREATMENT OF FABRICS

[76] Inventors: Jose-Maria C. Serracant; Juan C. Serracant, both of Paseo Can Feu, 68/80, Sabadell, Spain

[21] Appl. No.: 584,406

[22] Filed: Feb. 28, 1984

[51] Int. Cl.[4] ..... D06B 5/22

[52] U.S. Cl. ..... 68/181 R; 68/177

[58] Field of Search ..... 68/177, 176, 178, 184, 68/19, 181 R; 226/189, 190, 191; 242/55.01

[56] References Cited

U.S. PATENT DOCUMENTS

| | | | |
|---|---|---|---|
| 2,149,708 | 3/1939 | Recklinghausen et al. | 68/177 X |
| 2,701,717 | 2/1976 | Morrill | 68/176 X |
| 2,895,857 | 7/1959 | Boer | 68/177 X |
| 3,050,267 | 8/1962 | Tragert | 68/176 X |
| 3,389,584 | 6/1968 | Okazaki et al. | 68/177 |
| 3,434,642 | 3/1969 | Stanway | 226/191 |
| 3,608,807 | 9/1971 | Lee | 226/189 X |
| 3,978,696 | 9/1976 | Ito et al. | 68/184 X |
| 4,291,555 | 9/1981 | Barriquand | 68/177 X |

FOREIGN PATENT DOCUMENTS

| | | | |
|---|---|---|---|
| 500433 | 1/1951 | Belgium | 68/177 |
| 2439747 | 3/1976 | Fed. Rep. of Germany | 68/177 |

*Primary Examiner*—Philip R. Coe
*Assistant Examiner*—Frankie L. Stinson
*Attorney, Agent, or Firm*—Holman & Stern

[57] ABSTRACT

A machine for liquid treatment of fabrics in rope form forming a closed loop, which includes a mechanical draw device for cause the continuous advance movement of rope to a device for merely impregnate the rope with the treatment liquid and for producing a folded configuration to the impregnated rope, and conveying means synchronized with the draw device for carrying the folded rope from the impregnation and folding device to a point at which the rope is drawn up by the mechanical draw device.

6 Claims, 8 Drawing Figures

FIG. 2
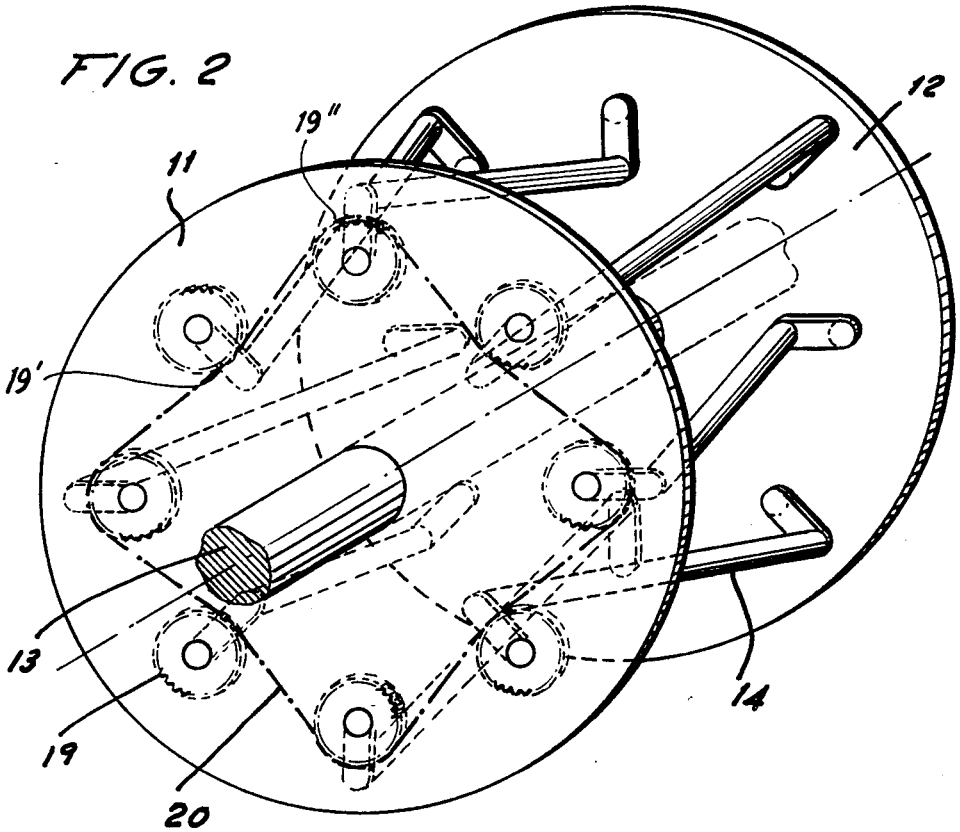
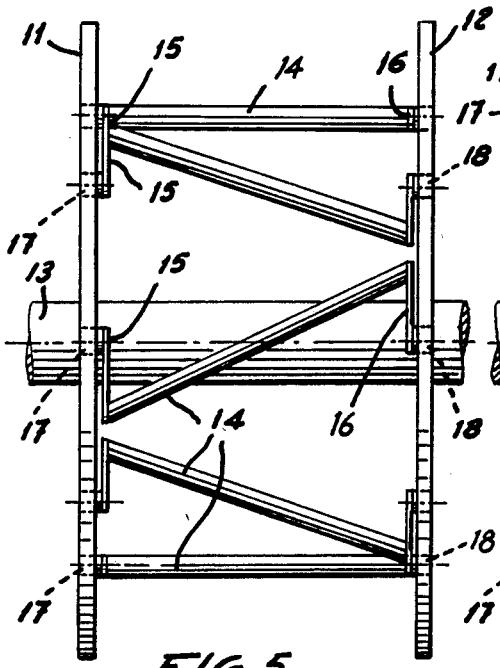
FIG. 5
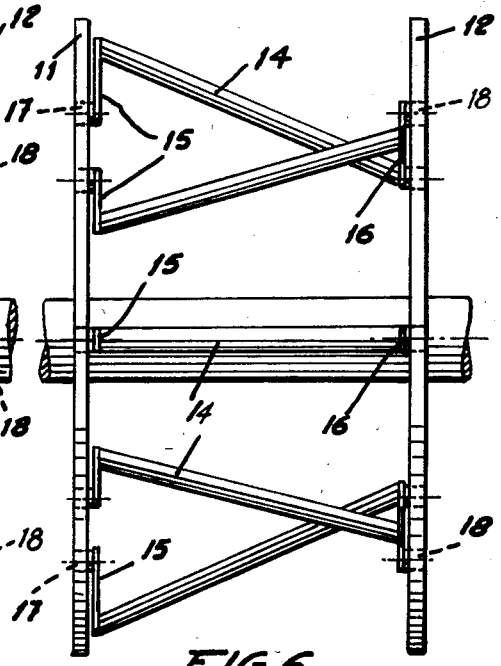
FIG. 6

MACHINE FOR LIQUID TREATMENT OF FABRICS

BACKGROUND OF THE INVENTION

1. Field of the Invention

The present invention relates to a machine for liquid treatment of fabrics in rope form forming a closed loop of the type that uses a reduced ratio of the treatment bath.

2. Description of the Prior Art

Machines of this type are already known comprising an impregnation device for the rope fabric with a treatment bath, a movable mechanical conveyor device with adjustable speed and being provided with a perforated supporting surface for the fabric, said surface being located above the level of the treatment bath which is contained in a lower vat, means for transferring the fabric from the impregnation device to the mechanical conveyor, and placing the fabric thereon so that pleats are formed, and a reel for guiding the fabric from the outlet of the mechanical conveyor to the inlet of said impregnation device.

In the German patent document Nos. 2,439,747 and 2,531,528 are described machines of this type wherein the rope mechanical conveyor is a linear conveyor having a conveyor rectilinear section and between the outlet and the inlet of this conveyor, the fabric is guided by a horizontally extending pipe having a length almost equal to that of the mechanical conveyor. Inside said pipe, the fabric is impregnated by the treatment liquid and at the same time the fabric is advanced through the inside of the pipe by the action of the liquid itself which is pressure-fed into the pipe through an annular nozzle, i.e. the fabric advance along said pipe is made by the transportation system called "jet".

Jasper & Co. GmbH's German Pat. No. 2,620,387 discloses a machine wherein the rope of fabric mechanical conveyor is provided with a perforated circular platform rotatively fitted above a fixed vat containing the treatment bath. In this machine, the fabric rope advance is also performed by the "jet" system i.e. by the action of the treatment liquid pressure in the impregnation device and also comprises an impregnation and guide pipe of the fabric rope which is circularly curved or wound above the circular conveyor and also comprises a reel for guiding the fabric from the conveyor to the dragging and impregnation device but said reel has not been designed to carry out the fabric advance.

All these machines have the disadvantage that with the fabric driving "jet" system used, the pressure injected liquid exerts a strong dragging action against the fabric which can then be damaged, particularly when short staple woven fabrics are dealt with. Also in these known machines it is very difficult to coordinate the speed transferred to the fabric by the liquid action with the speed at which the fabric is carried by means of the mechanical conveyor, so that it is easy for pilings or stresses to be produced in the fabric before or after its passage through the impregnation device.

SUMMARY OF THE INVENTION

The object of the present invention is to provide a machine for liquid treatment of fabrics in rope form making a closed loop of the type hereinbefore disclosed, i.e. of the type using a reduced ratio of a treatment bath wherein the fabric is impregnated by the treatment liquid and then transported making pleats while keeping the fabric from any contact with the treatment bath, and coming back again to be successively subjected to impregnation.

Another object of the invention is to provide a machine of said type whereby any possible danger of fabric damage when running through the several areas of the machine is avoided.

Still another object of the invention is to provide a machine of said type wherein the fabric travelling motion is obtained by mechanical means with exclusion of any hydraulic dragging action against the fabric.

With this purpose, the machine of the invention comprises a draw winch as a sole means for achieving the continuous motion of the ring of the fabric rope alongside the machine and which drives the fabric through a fabric impregnation device together with a treatment liquid, this liquid being poured without any pressure on the moving fabric so that the fabric is free from any dragging action, an inclined curved profile channel taking up the fabric rope together with the impregnation liquid and the rope being arranged to make pleats the rope is then released to a mechanical conveyor device of a known type, which allows the liquid to be separated from the rope and fall into a lower vat and carries the pleated fabric rope up to a point where the fabric is removed from the conveyor by said draw winch.

According to a preferred embodiment of the invention, said draw winch has a variable geometry which enables it to change the ideal interface with the fabric rope from a straight transverse profiled surface to a surface where the transverse profile is V-shaped, so that this surface can thus be adapted according to the kind of fibres making up the fabric to avoid any slippage between the fabric and the draw winch.

BRIEF DESCRIPTION OF THE DRAWINGS

These and other objects, features and advantages of our invention will be described in detail in the following description with reference to the annexed drawings, wherein:

FIG. 2 is a perspective view of the draw winch which is a portion of the machine of the invention;

FIG. 5 is an elevational view of the draw winch seen from the right-hand side of FIG. 2 with rods at the center position;

FIG. 6 is a similar view to that of FIG. 5 with rods alternatively shown at their opposed end positions;

DETAILED DESCRIPTION

Figure 1:
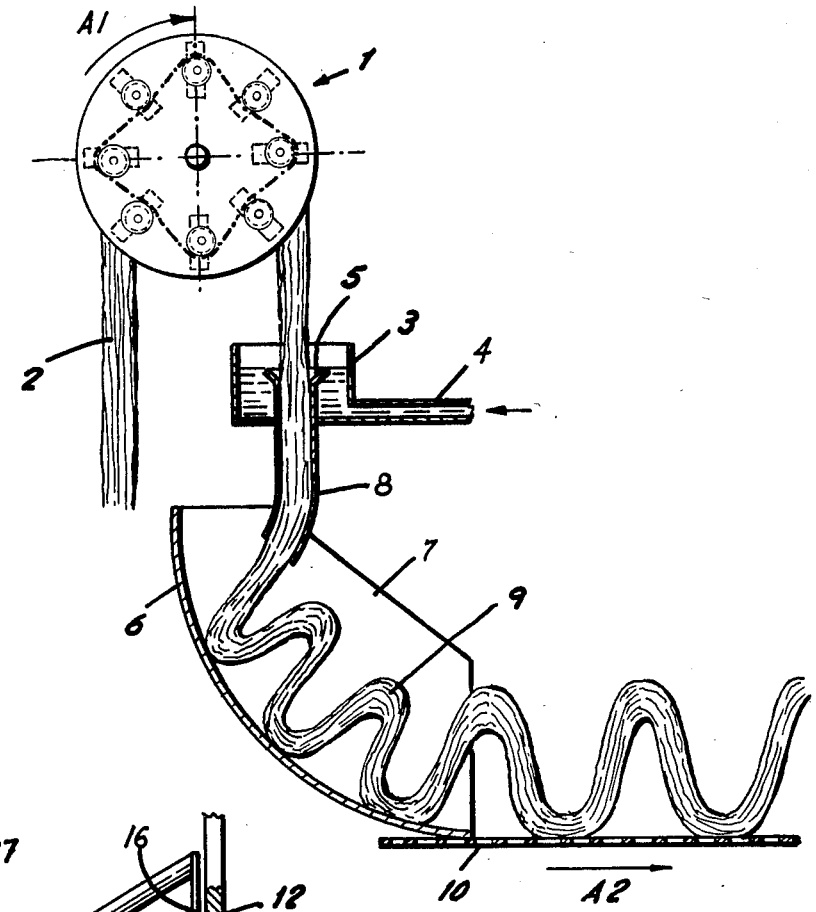
FIG. 1 is an elevational schematic view of the whole of the essential parts of the machine of the invention.

The machine according to the invention comprises a draw winch generally indicated by 1 provided with operating means which make it rotate in the direction of the arrow A1 in the FIG. 1. On this winch 1 passes a fabric piece in rope form 2 with its end sewn making a closed ring which is continuously moved by said winch 1.

Under this winch 1 from the outlet side of the fabric rope 2, there is an impregnating device provided with a reservoir 3 having an inlet conduit 4 by means of which a fabric treatment liquid, for instance a dyebath, reaches the reservoir 3, this reservoir having a spill edge 5 preferably with a circular shape which surrounds the fabric rope 2 in the position where it goes from the draw winch 1, so that said treatment liquid by simple gravity i.e. without being subjected to any pressure is in contact with the downwardly moving fabric rope 2 and falls down together with it.

Under said reservoir 3 the impregnating device further comprises a channel having a bottom 6 and two sidewalls 7 which bottom 6 is longitudinally curved and extends from an upper end essentially tangent to a vertical plane up to a lower end essentially tangent to a plane substantially horizontal.

The spill edge 5 of the reservoir 3 is downwardly extended to a guide 8 leading the fabric rope 2 together with the accompanying treatment liquid against the upper portion of the bottom 6 of said channel, so that the fabric the form of pleats 9 inside said channel and becomes impregnated with this treatment liquid.

Channel 6,7 ends up over a mechanical conveyor device which comprises a perforated surface 10 is otherwise made, to enable the treatment liquid to pass through to be collected in a lower vat, not illustrated, and from which vat it is conducted, in a known way, by means of a pump towards the inlet conduit 4 of the reservoir 3. Said conveyor device can be of any known type, for instance, made with several superimposed conveyor belts oppositely driven by a rotating circular platform or otherwise, capable of leading the pleated rope 9 up to a point where the rope is removed from the conveyor by the draw winch 1.

To achieve an uniform treatment of the fabric and avoid irregularities particularly if the machine is used for fabric dyeing, it is necessary to avoid piling of the fabric rope being formed at the inlet or at the outlet of the mechanical conveyor 10 and for this purpose and according to the invention, the operating means of said mechanical conveyor 10 are synchronized with the operating means of the draw winch 1. But it is further essential that any slippages cannot be produced between the fabric rope and the draw winch 1 and it is to be borne in mind that the possibilities of slippages being produced can be originated by the kind of fabric material, for instance, slippage trend is higher in a fabric manufactured with synthetic fibres.

With this purpose in mind the draw winch 1 consists of two plates 11 and 12 fixed on a driven shaft 13 and a plurality of rods 14 transversally arranged between the two plates 11,12.

Figure 3:
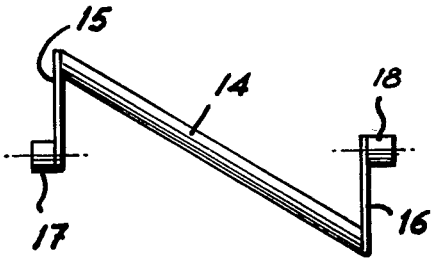
FIG. 3 is a plan view showing the shape of the rods in the draw winch.
Figure 7:
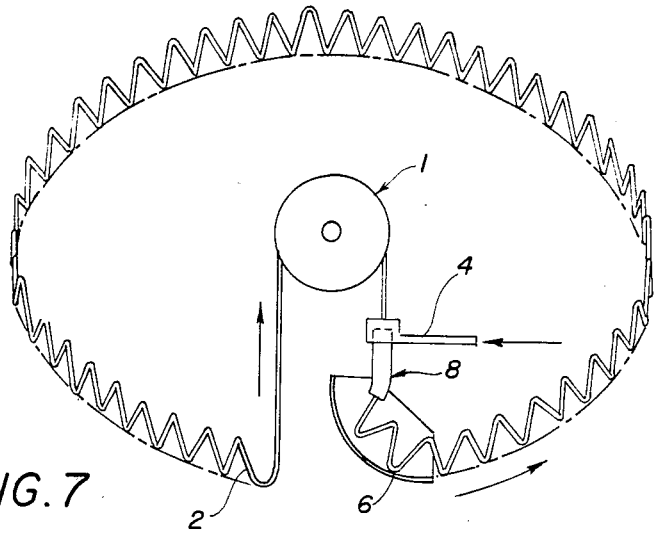
FIG. 7 is a perspective schematic view showing the loop arrangement for the machine of the invention.
Figure 8:
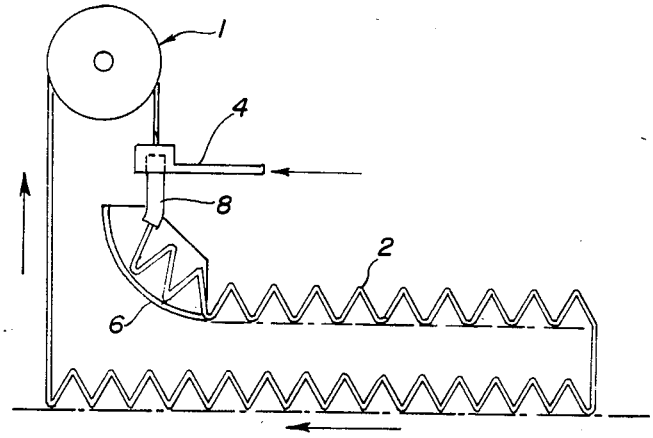
FIG. 8 is a view similar to FIG. 7 in different perspective.

As shown in FIG. 3, said rods 14 are longer than the clearance between the two plates 11 and 12 and two arms 15 and 16 are joined to both ends of the rods making with the rod 14 opposed and equal angles, giving the rod unit a shape similar to a "Z". At the free ends of these arms 15 and 16 short shafts 17 and 18 parallel to each other are fixed, these shafts being rotatively housed in associated holes in plates 11 and 12 distributed thereon on a locus of points concentric to the axis of the winch shaft 13.

Figure 4:
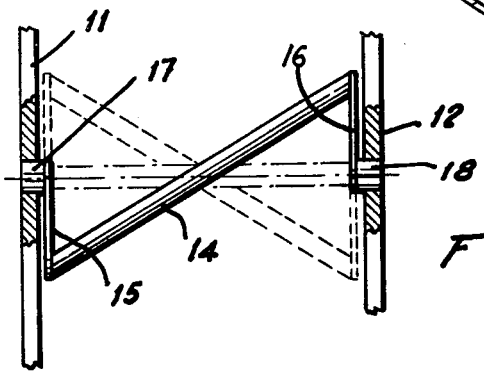
FIG. 4 is a partly cross-sectional view showing a rod of FIG. 3 fitted on the winch and showing the two end positions and the center position said rod can be made to adopt.

With this arrangement each of the rods 14 of the winch can adopt three main positions and all the intermediate positions between them. In FIG. 4 are shown these three main positions, namely a first extreme position in full lines wherein the arm 15 is located in the plane of the drawing and downwardly directed, the arm 16 is located in the drawing plane and upwardly directed and consequently the rod 14 remains located in the drawing plane inclined upwardly from the lower left-hand portion of the drawing towards the upper right-hand portion; a second extreme position in dashed lines reversed as regards the first position and wherein the rod 14 is also located in the drawing plane and inclined downwardly from the upper left-hand portion towards the lower right-hand portion; and in dot and dash lines the rod in the middle position is shown, with the arms 15 and 16 located in planes perpendicular to the drawing plane and consequently the rod 14 is located in a plane rearwardly inclined with respect to the drawing plane. Rod 14 obviously can be located at any other position between those dispersed above.

Successive rods 14 fitted between the plates 11 and 12 of the winch 1 can be arranged at alternate opposed positions which can be varied from the positions shown in FIG. 5, wherein each of the rods 14 is located in a plane parallel to the winch shaft 13 up to the positions shown in FIG. 6 wherein each of the rods 14 is located in a diametral plane of the draw winch and alternately inclined oppositely so that each two adjacent rods 14 are crosslinked in space. This latter position of the rods 14 makes the fabric rope 2 follow on the winch 1 in a wavy running that ensures dressing of the rope by the winch, and thereby prevents any slippage between them when a slippage-prone fabric is being treated. In the fabrics with less slippage characteristics the position of the rods 14 can be varied up to the extreme position shown in FIG. 5.

Preferably one of the shafts 17 of the two extreme shafts 17 and 18 of all the rods 14 is outwardly projected from its housing in the plate 11 and on each of said projected shafts 17 a toothed chain wheel is fitted. A chain 20 (FIG. 2) engages all these toothed wheels 19; this chain alternately engaging the inner and outer portions, with respect to the shaft 13, of the toothed wheels, for example, at 19', 19'', etc. This arrangement enables concurrently shifting all the rods 14 of the draw winch 1 in alternately opposite directions and in equal angles.

We claim:

1. In a machine for liquid treatment of fabrics in rope form in a closed loop, including driving means for continuously moving the fabric rope, means for impregnating the fabric rope with the treatment liquid, means for folding the fabric rope, and mechanical conveyor means for conveying the impregnated fabric rope in the loop, the improvement comprising:

a draw winch for optimum driving of the fabric rope produced by a maximum dragging circumference in contact with said fabric rope, including a rotatably driven shaft, two separated plates mounted on said shaft to be rotated thereby, and a plurality of rods fitted between said two plates, with the ends of the rods mounted in said plates, said rods being inclined with respect to said plates with the inclination of adjacent rods being oppositely directed, the fabric rope being run on said rods in engagement therewith to produce a continuous motion of said fabric rope;

a reservoir located downstream of said draw winch having an inlet for the treatment liquid;

a guide tube extending through the bottom of said reservoir having a funnel-shaped spill edge at the upper end thereof in said reservoir so that the treatment liquid flows over said spill edge and through said guide tube by gravity, said fabric rope passing through said funnel-shaped end and guide tube to produce intense impregnation of the fabric without any dragging effect;

an open inclined channel in which folds are formed in the fabric rope, having a longitudinally curved bottom, upstanding sidewalls, an upper end located under said reservoir and guide tube for receiving therefrom the impregnated fabric rope and the treatment liquid flowing through the guide tube, and a lower end from which said fabric rope is discharged from the channel; and a mechanical conveyor device, at least part of which is located under the lower end of said channel to receive the fabric rope and treatment liquid therefrom and driven in synchronization with said draw winch, including means to allow said treatment liquid to pass through it for separation of the liquid from the fabric rope, and means for moving the fabric rope to a position substantially under the draw winch where the fabric rope is removed from the conveyor device by said draw winch.

2. A machine according to claim 1, wherein said winch rods are longer than the clearance between said two winch plates, and arms are fixed to respective ends of each rod at equal angles, said arms being provided at their free ends with respective mounting shafts in alignment with each other, said mounting shafts being rotatively mounted in said two winch plates in circumferentially spaced relationship.

3. A machine according to claim 2, wherein said mounting shafts in one of said winch plates protrude from the outside face of said one winch plate, a toothed wheel is provided on each protruding shaft, and a closed chain is provided operatively engaging said toothed wheels on opposite portions of adjacent wheels with respect to said driven draw winch shaft, so that the inclination of all said rods can be simultaneously varied in equal angles and adjacent rods rotate oppositely with respect to each other.

4. A machine for liquid treatment of fabrics in rope form in a closed loop, comprising:

a draw winch for moving the fabric rope in a closed loop through the machine comprising a driven shaft, two spaced plates fixedly mounted on said shaft, a plurality of rods having a substantially Z-shaped configuration arranged between said two plates and rotatably mounted at their ends in said plates, so that said rods when rotated define a body of revolution comprised of two cones having oppositely disposed apecis to produce maximum contact between the rods and the fabric rope during movement of the fabric rope over the draw winch;

an impregnating device for the fabric rope located downstream only of the draw winch comprising a reservoir, an inlet in said reservoir for treatment liquid, a pipe extending through the bottom of the reservoir upwardly and protruding below the reservoir bottom, a funnel-shaped upper end on the pipe having a spill edge under the liquid-free level in the reservoir, the fabric rope passing downwardly through said pipe driven by said winch and the treatment liquid itself, without said treatment liquid applying any pressure or dragging effect on the fabric rope;

a channel member comprising an inclined open and curved profiled channel having an upper end positioned to receive the impregnated fabric rope from said pipe, and a lower end positioned to deliver the fabric rope to a conveyor; and a conveyor device moved synchronously with the draw winch and positioned to receive the impregnated fabric rope from the channel lower end, and means to enable the treatment liquid to pass through said conveyor device for the separation of the liquid from the fabric rope, said conveyor device moving the fabric rope to a position located under the draw winch where the fabric rope is removed from the conveyor by said draw winch.

5. A machine according to claim 4, wherein each Z-shaped rod has shafts on the opposite ends thereof rotatably mounted in said two plates which are aligned with each other and the middle point of the respective rod between the two plates, and define a maximum ideal circumference, so that the profile of the Z-shaped rods during rotation of the winch shifts between a substantially straight profile parallel to the draw winch shaft and a substantially V-shaped profile with respect to said draw winch shaft, providing a maximum ideal interface of the rods with the fabric rope.

6. A machine according to claim 5, and further comprising a geared device operatively connected to the ends of said rods at one of said plates to simultaneously adjust the position of the rods.

* * * * *